United States Patent [19]

Langlois et al.

[11] Patent Number: 4,737,918

[45] Date of Patent: Apr. 12, 1988

[54] APPARATUS FOR CENTERING AND PLACING AN ADAPTER ON AN OPTICAL LENS BLANK AND FOR CONTROLLING A GRINDER

[75] Inventors: Jean-Pierre Langlois, Cleon; Jean C. Paimpol, Elbeuf, both of France

[73] Assignee: Briot International, France

[21] Appl. No.: 870,775

[22] Filed: Jun. 4, 1986

[30] Foreign Application Priority Data

Jun. 10, 1985 [FR] France ..... 85 08723

[51] Int. Cl.[4] ..... G05B 19/18; B24B 9/14

[52] U.S. Cl. ..... 364/474; 51/165.71; 51/165.72; 51/101 LG; 364/473

[58] Field of Search ..... 364/474, 475, 473, 474.06, 364/474.34, 474.22; 51/165.71, 165.72, 101 LG, 105 LG; 351/177

[56] References Cited

U.S. PATENT DOCUMENTS

| | | | |
|---|---|---|---|
| 4,524,419 | 6/1985 | Headlund et al. | 364/474 |
| 4,640,055 | 2/1987 | Badin et al. | 364/474 |
| 4,656,590 | 4/1987 | Ace | 364/474 |

*Primary Examiner*—Jerry Smith
*Assistant Examiner*—Allen MacDonald
*Attorney, Agent, or Firm*—McGlew and Tuttle

[57] ABSTRACT

The apparatus comprises a flat electronic screen (7), means (14) for displacing on the screen an image, stored in a data bank (9), of a given template or frame of spectacles, and means (8) for recording the displacements of the image on the screen (7), storing in memory the differences of its final coordinates with respect to a reference position constituted by the intersection of two orthogonal axes X, Y and calculating the resulting data and applying them directly to a grinder (11).

11 Claims, 2 Drawing Sheets

APPARATUS FOR CENTERING AND PLACING AN ADAPTER ON AN OPTICAL LENS BLANK AND FOR CONTROLLING A GRINDER

The present invention relates to the centering of optical lens blanks prior to the grinding of the latter to the dimension of the rims of a given frame of spectacles on a grinder and to the ordering of a pre-calibrated lens.

It is known that an optical lens blank is maintained between two ends of a divided shaft of a grinder by means of an adapter which is usually a suction element applied with precision on the axis of rotation of the blank.

This centering of the adapter is a complex operation which must be carried out in taking into account various factors which are different for each user. The precision of this operation governs the good execution of the grinding of the blank and the optimum adaptation of the lenses to the wearer of the finished spectacles.

It is known to employ electronic systems for controlling grinders by means of data banks storing the characteristics of different frames, or by means of a device including a follower which measures radii of a frame or of a special template and produces data signals which are applied to the grinder through a computer provided with a screen displaying the shape of the rims of the frame or that of the template for checking purposes.

European patent application No. 0 092 364 discloses in particular a process and an apparatus for carrying out said process, as French patent application No. 84/06858 which is more particularly concerned with a grinder having a numerical control.

However perfected and practical these processes and apparatus may be, they lack an important feature as concerns the operation, which is of prime importance, on one hand, for the good execution of the grinding and, on the other hand, for the perfect adaptation of the finished spectacles to the user or wearer, and which consists in the centering of the adapter on the lens blank.

In the present state of the art, this operation prior to the grinding is carried out separately, and the main processes in most current use are:

The real, manual superposition of the lens against the template or the frame; this solution lacks precision since it does not permit a suitable checking of the respective centres.

The use of a system of semi-mirrors which permits the direct observation of the superposition of the optical images of the template and the lens and which is placed on a transparent, graduated plate.

The use of an optical prism system which provides the same superposition of images.

After having mounted the adapter, the blank and the template are transferred to the grinder, or there may be used an apparatus such as that described in the aforementioned patent applications, if if stores in memory the data of the template or the frame.

An object of the invention is to simplify these various operations by providing an improved apparatus for centering and placing the adapter on an optical lens blank in a more precise manner, this apparatus itself establishing the data required for directly controlling the grinder as a function of the morphological particulars of the wearer and the particulars of the chosen frame.

The invention therefore provides an apparatus for centering and placing an adapter on an optical lens blank and for automatically establishing the data required for the grinding of the blank on a grinder, and adapted to directly control the grinder, this apparatus being of the type comprising a bank of data stored in memory, and a computer with a display screen, said apparatus being characterized in that it comprises a flat electronic screen, means for displaying and displacing on said screen an image, stored in said bank of data, of a given frame of spectacles or a given template, and means for recording the displacements of said image on the screen, storing in memory the differences of the final coordinates with respect to a reference position, and calculating the resulting data and applying them directly to a grinder, and a pivotal device for mounting the adapter including optical sighting means and a support for the adapter.

According to another feature of the invention, said flat screen is of the liquid crystal type.

Preferably, a sheet of transpareant material is disposed on said screen and includes in the middle thereof two graduated orthogonal axes.

According to one embodiment of the invention, said means for displaying and displacing an image of a given frame of spectacles or a template on the screen comprise a programmable electronic computer.

Advantageously, said means for recording the displacements of the image on the screen and storing in memory the differences of these final coordinates relative to the position of the acquired or stored data, are constituted by said computer.

The following description, with reference to the accompanying drawings given by way of non-limiting examples, will explain how the present invention can be carried into effect.

Figure 1:
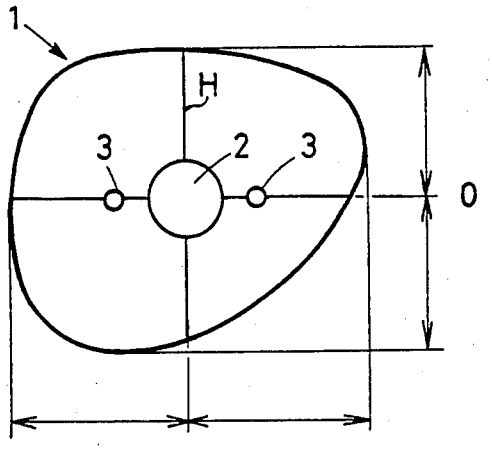
FIG. 1 is a plan view of a template showing its axis and its geometric centre.

With reference to FIG. 1, a template 1 is conventionally provided with an aperture 2 in its centre and also includes two small apertures 3 equally spaced from the centre of the aperture 2 and defining an axis of origin O which is parallel to a straight line through the pupils of the wearer when the template is mounted on spectacles worn by the wearer. The template also includes a second axis H orthogonal to the axis O and passing through the geometric centre of the template.

Figure 2:
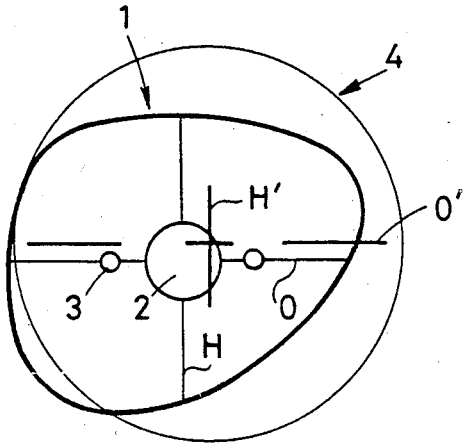
FIG. 2 shows a traced-out optical lens superposed on a template.

An optical lens blank designated by the reference numeral 4 in FIG. 2 carries, marked thereon, two orthogonal axes O′ and H′ which cross at the optical centre of the blank and are usually marked by means of an erasable ink.

Figure 3:
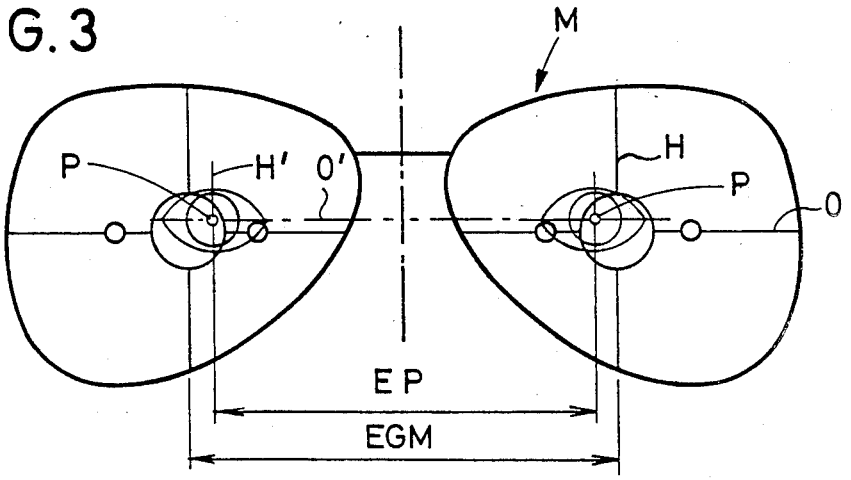
FIG. 3 shows diagrammatically the eyes of a wearer wearing a frame of spectacles on which are adapted templates such as that shown in FIG. 1.

With reference to FIG. 3, the pupils P of a wearer wearing a frame of spectacles M are spaced apart a distance termed pupillary spacing EP while the geometric centres of the templates (or of the rims of the frame) are spaced apart a distance EGM which represents the geometric spacing of the frame and is, in the presently-described embodiment, a little greater than the spacing EP.

It will be understood that, in the finished spectacles, the centre of each lens, i.e. its optical centre, must be as close as possible to the pupil of the wearer. It is therefore advisable to position the lenses on the templates in such manner as to obtain the optimum position of the centre of the blank relative to the pupils and to the centres of the templates.

When this position is reached, an adapter is placed on the centre of rotation of the lens which corresponds to the geometric centre of the template, in the conventional manner.

The apparatus according to the invention permits achieving this centering with ease and precision.

Figure 4:
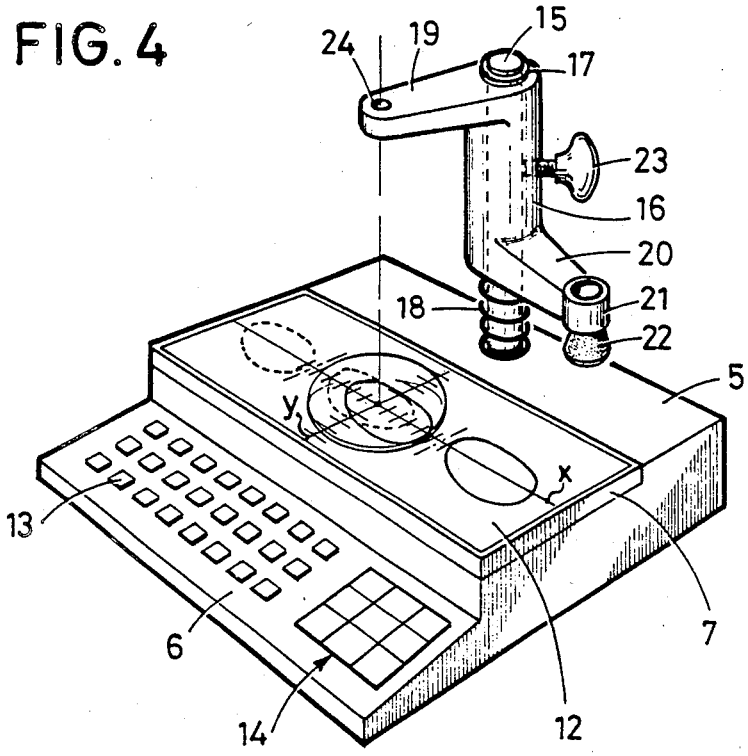
FIG. 4 is a perspective view of the apparatus according to the invention.
Figure 5:
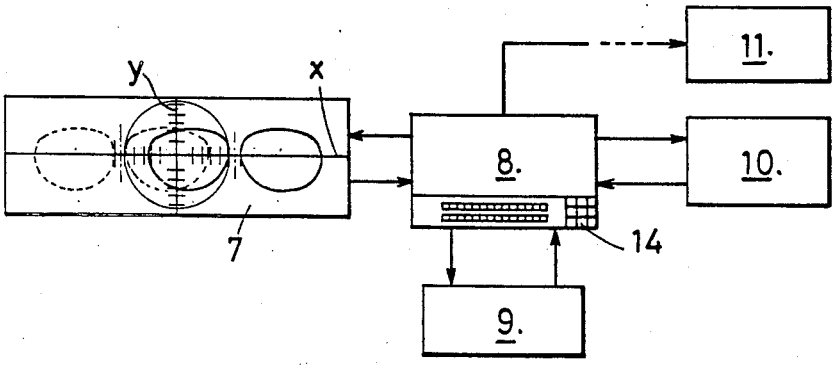
FIG. 5 is a block diagram of the apparatus shown in FIG. 4.

This apparatus, shown in perspective in FIG. 4, comprises a support 5 including a keyboard 6, the unit having for example a shape similar to that of a conventional typewriter.

The support 5 carries in its upper part a flat electronic screen 7 which is for example a display screen of the liquid crystal type.

Mounted on the opposite side of the screen 7 to the keyboard, is an optical sighting device which will be described in more detail hereinafter.

The support 5 contains an electronic unit consisting of a computer 8 suitably connected to the screen 7, a data bank 9 or some other appropriate memory system in which are stored the data of the various spectacles frames, and a data acquiring device 10. This electronic unit is connected to a grinder 11 having a numerical control.

Disposed on the screen 7 is a sheet 12, for example of a transparent plastics material or glass, carrying in the centre two graduated orthogonal axes X, Y.

In addition to the conventional keys 13 for operating the computer 8, the keyboard 6 includes a control device 14 which consists of keys in the presently-described embodiment.

The device mounted in the rear part of the support 5 comprises a fixed vertical pillar 15 on which is slidably mounted an elongated body 16 biased upwardly against an abutment 17 by a spring 18. The body 16 has at one end a first horizontally extending arm 19, and at its opposite end a second horizontally extending arm 20 which is offset 90° from the arm 19 and is of the same length as the latter.

The arm 19 carries at its end an optical device 24, the length of the arm being so adapted that this device 24 can be brought vertically above the intersection of the axes X, Y of the sheet 12. The arm 20 carries at its ends a support 21 adapted to receive a removable adapter 22, for example consisting of a suction element. The body 16 is rotatively mounted on the pillar 15 and can be shifted in height along this pillar by a control element 23.

According to the process of the invention, there is made to appear in a reference position on the screen 7 by means of the computer 8 the full-scale image of a frame chosen among those of which data is stored in the bank 9.

Knowing the pupillary spacing of the wearer (previously measured), the image of the frame on the screen 7 is displaced along the axis X on the transparent sheet 12, through a distance corresponding to the measured value of the pupillary spacing, and centered on the axis Y, by means of the control keys 14. The image is then displaced in a direction parallel to the axis Y so as to adjust in height the pupil of the wearer relative to the bottom of the frame (or to the axis X). As the computer has stored in memory the data corresponding to the chosen frame of spectacles, it records the displacements of the image from its position of the acquired or stored position and calculates the differences relative to the data of the frame and restores the shape of the frame centered in accordance with the pupillary position of the wearer.

The lens blank is then manually placed on the screen so that its optical centre coincides with the intersection of the axes X, Y, and it is checked, by means of the optical device 24 which permits a viewing of the image without parallax correction, that the image of the frame rim (or of the template) is actually contained within the blank.

The body 16 of the device is then turned through 90° so as to bring the adapter 22 in position above the blank and to place it on the latter.

The operation will of course be repeated with the second rim of the frame, the adapter being thus practically fixed on the optical axis of the lens.

The acquisition device 10 contained in the electronic unit of the apparatus may be a device such as that described in the U.S. Pat. No. 3,899,851 which comprises a follower adapted to follow the contours of a frame rim or of a template and to deliver signals which may be directly input into to the computer 8 instead of the data stored in the bank 9.

It is clear from the foregoing that the apparatus according to the invention permits obtaining automatically the data required for controlling a grinder used to grind the lenses to be mounted in a chosen spectacle frame, by introducing in the computer connected to the screen morphological particulars of the wearer.

In the case of special lenses (pre-calibrated lenses) to be bought, the apparatus according to the invention permits also to determine the characteristics of the lens: maximum diameter and critical radii.

The apparatus may also make use of:

(1) The electronic data of a copier of a frame of spectacles such as described in the U.S. Pat. No. 3,899,851.
(2) The data of one or more data banks outside the system grouping one or more stored shapes.
(3) The data given in the form of coded badges.
(4) The data of a microcomputer.

The fact that all the displacements of the image of frame of spectacles are seen on the screen is advantageous since it permits a precise digital reading.

It will of course be understood that the aforementioned electronic devices are all conventional and do not need to be described in detail. They permit a direct connection of the computer 8 with the grinder 11 so as to control the latter directly.

It will be observed that the apparatus according to the invention permits a direct control of the grinder as a function of the measurements made by moving the image of the frame of spectacles on the screen 7 of the apparatus.

If desired, a printer may be connected to the computer 8 for the purpose of printing all the dimensions of a given lens intended for the manufacturer for producing this lens for a given frame and a given client (precalibrated lenses).

As the screen 7 employed has a definition of a few tenths of a millimeter, a completely satifactory precision is achieved with the apparatus according to the invention.

Alternatively, the computer may be adapted to show the orthogonal axes X, Y directly on the screen.

What is claimed is:

1. A process for adjusting the position of an optical lens blank relative to a template or to a rim of a frame of spectacles and for centering an adapter on the center of rotation of the blank, said process comprising displaying a full-scale image of a frame of spectacles or of a template on a flat electronic screen showing orthogonical axis X, Y and connected to an electronic computer, bringing the image of a rim of the frame into a reference position, moving said image along said axis through a distance corresponding to the value of the pupillary spacing of the wearer, and adjusting the position of the image in height in the direction of axis Y as a function of the height of the pupil relative to the base of the frame, placing the lens blank on the screen in coincidence with said reference position, checking that the image of the frame does not extend beyond the blank, and placing an adapter on the optical axis of the lens.

2. An apparatus for centering and placing an adapter on an optical lens blank and for automatically establishing data required for the grinding of the blank on a grinder, and adapted to directly control the grinder, said apparatus comprising a bank of data stored in a memory, a computer including an electronic display screen which is flat, a mechanical adapter placing device, means for displaying and displacing on said screen an image, stored in said bank, of a frame of spectacles or of a given template, and means for recording displacements of said image on the screen, storing in memory differences between the final coodinates of the image with respect to a reference position constituted by the intersection of two orthogonal axes X,Y and calculating data resulting therefrom and applying said data directly to a grinder.

3. An apparatus according to claim 2, wherein said flat screen is a liquid crystal screen.

4. An apparatus according to claim 3, comprising a sheet of transparent material disposed on said screen and including in the middle thereof said orthogonal axes X, Y, said axes being graduated.

5. An apparatus according to claim 4, wherein said means for displaying and displacing the image of at least one of: the frame and of the template on the screen are comprised of said computer.

6. An apparatus according to claim 5, wherein said means for recording the displacements of the image on the screen and storing in memory the differences of its final coordinates with respect to said reference position comprise said computer.

7. An apparatus according to claim 3, wherein said means for displaying and displacing at least one of: the image of the frame and of the template on the screen are comprised of said computer.

8. An apparatus according to claim 7, wherein said means for recording the displacements of the image on the screen and storing in memory the differences of its final coordinates with respect to said reference position comprise said computer.

9. An apparatus according to claim 2, wherein said means for displaying and displacing the image of the frame or of the template on the screen are comprised of said computer.

10. An apparatus according to claim 9, wherein said means for recording the displacements of the image on the screen and storing in memory the differences of its final coordinates with respect to said reference position comprise said computer.

11. An apparatus according to claim 2, comprising a support on which are fixed said flat screen, a control keyboard, and a device for optically sighting and placing the adapter, which is positioned on the opposite side of the screen to the keyboard, said computer being mounted within said support.

* * * * *